US009433242B1

(12) United States Patent
Buffone

(10) Patent No.: US 9,433,242 B1
(45) Date of Patent: Sep. 6, 2016

(54) MOBILE DEVICE CASE WITH AN ELECTRONIC CIGARETTE COMPARTMENT

(71) Applicant: Christopher Steven William Buffone, Greenwich, CT (US)

(72) Inventor: Christopher Steven William Buffone, Greenwich, CT (US)

( * ) Notice: Subject to any disclaimer, the term of this patent is extended or adjusted under 35 U.S.C. 154(b) by 0 days.

(21) Appl. No.: 14/590,104

(22) Filed: Jan. 6, 2015

(51) Int. Cl.
*A24F 15/18* (2006.01)
*A24F 47/00* (2006.01)

(52) U.S. Cl.
CPC ..... *A24F 15/18* (2013.01); *A24F 47/002* (2013.01)

(58) Field of Classification Search
CPC ..... A24F 15/00; A24F 15/20; A24F 15/12; A24F 15/18; A24F 13/08; H02J 7/054; H02J 7/00
USPC ..... 206/236
See application file for complete search history.

(56) References Cited

U.S. PATENT DOCUMENTS 2,490,141 A * 12/1949 Lotterer ..... B42D 5/022 211/120
3,743,136 A * 7/1973 Chambers ..... A24F 15/12 206/259
4,075,702 A * 2/1978 Davies ..... A45C 15/00 150/135
4,207,976 A * 6/1980 Herman ..... B65D 85/109 206/246
4,342,902 A * 8/1982 Ping ..... A24F 15/14 219/261
4,724,527 A * 2/1988 Nishimura ..... G06Q 20/341 708/106
4,793,478 A * 12/1988 Tudor ..... B65D 85/1081 206/256
5,006,699 A * 4/1991 Felkner ..... G06F 15/0216 235/375
6,321,757 B1 * 11/2001 McCutcheon ..... A24F 15/18 131/231
6,446,793 B1 * 9/2002 Layshock ..... A24F 15/18 206/85
6,619,349 B2 * 9/2003 Gribovsky ..... A45C 1/06 150/135
7,290,953 B2 * 11/2007 Regala ..... B42D 5/006 401/131
8,490,789 B2 * 7/2013 Lach ..... A45C 11/00 206/320
D705,763 S 5/2014 Fastman et al.
8,774,446 B2 7/2014 Merenda
2004/0103907 A1 * 6/2004 Collett ..... A24F 13/18 131/235.1
2005/0236282 A1 * 10/2005 Huska ..... A24F 13/18 206/246

(Continued)

OTHER PUBLICATIONS https://www.indiegogo.com/projects/vqase-the-world-s-1st-true-phone-case-e-cigarette.

*Primary Examiner* — Anthony Stashick
*Assistant Examiner* — Ernesto Grano
(74) *Attorney, Agent, or Firm* — Hunton & Williams LLP

(57) ABSTRACT

An embodiment of the present invention is directed to a mobile device case comprising a compartment configured to securely hold an electronic cigarette or vaporizer. For example, the mobile device case comprises: a mobile device section configured to securely hold a mobile device; and a compartment attached along one side of the mobile device section, the compartment comprising: container configured to securely hold an e-cigarette device; a hinged lid at one end of the container configured to close and open the container; and a spring mechanism connected to the hinged lid so that when the hinged lid is open, the spring mechanism pushes the e-cigarette device out of the container.

11 Claims, 7 Drawing Sheets

(56) References Cited

U.S. PATENT DOCUMENTS

2006/0257200 A1* 11/2006 Busam ..... B42D 3/12 401/195
2008/0179113 A1* 7/2008 Carlson ..... G06F 1/1626 178/19.01
2008/0185303 A1* 8/2008 He ..... B65D 85/1009 206/249
2009/0283103 A1* 11/2009 Nielsen ..... A24F 1/30 131/273
2009/0325648 A1 12/2009 Shi
2010/0124040 A1* 5/2010 Diebel ..... G06F 1/1628 361/816
2011/0068026 A1* 3/2011 Fakhouri ..... A24F 9/04 206/244
2011/0233078 A1 9/2011 Monaco et al.
2012/0224739 A1 9/2012 Cataldo et al.
2013/0220847 A1* 8/2013 Fisher ..... B65D 25/005 206/216
2013/0312775 A1* 11/2013 Cortesi ..... A24F 13/18 131/237
2013/0336358 A1* 12/2013 Liu ..... G01K 13/002 374/152
2013/0341218 A1* 12/2013 Liu ..... A24F 15/18 206/242
2013/0342157 A1* 12/2013 Liu ..... A24F 15/18 320/107
2014/0007892 A1* 1/2014 Liu ..... G08C 23/02 131/329
2014/0014125 A1* 1/2014 Fernando ..... A24F 47/008 131/328
2014/0020697 A1* 1/2014 Liu ..... A24F 15/00 131/329
2014/0053858 A1* 2/2014 Liu ..... A24F 15/18 131/329
2014/0130816 A1* 5/2014 Liu ..... A24F 47/008 131/329
2014/0196731 A1* 7/2014 Scatterday ..... A45C 13/005 131/329
2014/0262934 A1* 9/2014 Fathollahi ..... A45C 13/002 206/774
2015/0097513 A1* 4/2015 Liberti ..... A24F 47/00 320/103
2015/0101940 A1* 4/2015 Ash ..... H04M 1/21 206/216
2015/0164138 A1* 6/2015 Liu ..... H01M 2/1044 206/268

* cited by examiner

MOBILE DEVICE CASE WITH AN ELECTRONIC CIGARETTE COMPARTMENT

FIELD OF THE INVENTION

The present invention relates to a mobile device case with a compartment configured to securely hold an electronic cigarette, vaporizer and other personal items.

BACKGROUND OF THE INVENTION

Mobile devices are increasing in popularity as they become more sophisticated and even easier to use. Mobile devices, such as smart phones, mobile players, mobile readers, etc., are oftentimes the single device that anyone will have with them at all times. Current mobile device cases are limited to carrying just the mobile device. Some mobile device cases provide a mechanism to carry a few personal items, granted that they can fit in the mobile device case. However, there are limited cases that provide the ability to carry another electronic device along with the mobile device. In particular, users of e-cigarettes or vaporizers usually need a separate carrying case for each device.

These and other drawbacks exist.

SUMMARY OF THE INVENTION

Accordingly, one aspect of the invention is to address one or more of the drawbacks set forth above. According to an embodiment of the present invention, a mobile device case comprises: a mobile device section configured to securely hold a mobile device; and a compartment attached along one side of the mobile device section, the compartment comprising: container configured to securely hold an e-cigarette device; a hinged lid at one end of the container configured to close and open the container; and a spring mechanism connected to the hinged lid so that when the hinged lid is open, the spring mechanism pushes the e-cigarette device out of the container.

According to another embodiment of the present invention, a mobile device case comprises: a mobile device section configured to securely hold a mobile device; and a compartment attached along one side of the mobile device section, the compartment comprising: a container configured to securely hold a e-cigarette device; and an opening along the container to access the e-cigarette device.

According to yet another embodiment of the present invention, a mobile device case comprises: a mobile device section configured to securely hold a mobile device; and a card section comprising multiple slotted sections configured to hold one or more personal items; a middle section between the mobile device section and the card section, wherein the middle section comprises a grooved based with a plurality of straps configured to securely hold an e-cigarette device.

These and other embodiments and advantages of the invention will become apparent from the following detailed description, taken in conjunction with the accompanying drawings, illustrating by way of example the principles of the various exemplary embodiments.

BRIEF DESCRIPTION OF THE DRAWINGS

In order to facilitate a fuller understanding of the present inventions, reference is now made to the appended drawings. These drawings should not be construed as limiting the present inventions, but are intended to be exemplary only.

DETAILED DESCRIPTION OF EXEMPLARY EMBODIMENT(S)

The following description is intended to convey an understanding of the present invention by providing specific embodiments and details. It is understood, however, that the present invention is not limited to these specific embodiments and details, which are exemplary only. It is further understood that one possessing ordinary skill in the art, in light of known systems and methods, would appreciate the use of the invention for its intended purposes and benefits in any number of alternative embodiments and configurations, depending upon specific design and other needs.

An embodiment of the present invention is directed to a mobile device case that holds a mobile device (e.g., mobile phone, smart phone, personal digital assistant, etc.) and an electronic cigarette or vaporizer ("e-cigarette"). The mobile phone case protects the mobile device and the e-cigarette and facilitates the transportation of these devices. According to another embodiment of the present invention, the mobile device case further protects, stores and organizes other items, such as currency, credit cards and identification cards.

Figure 1A:
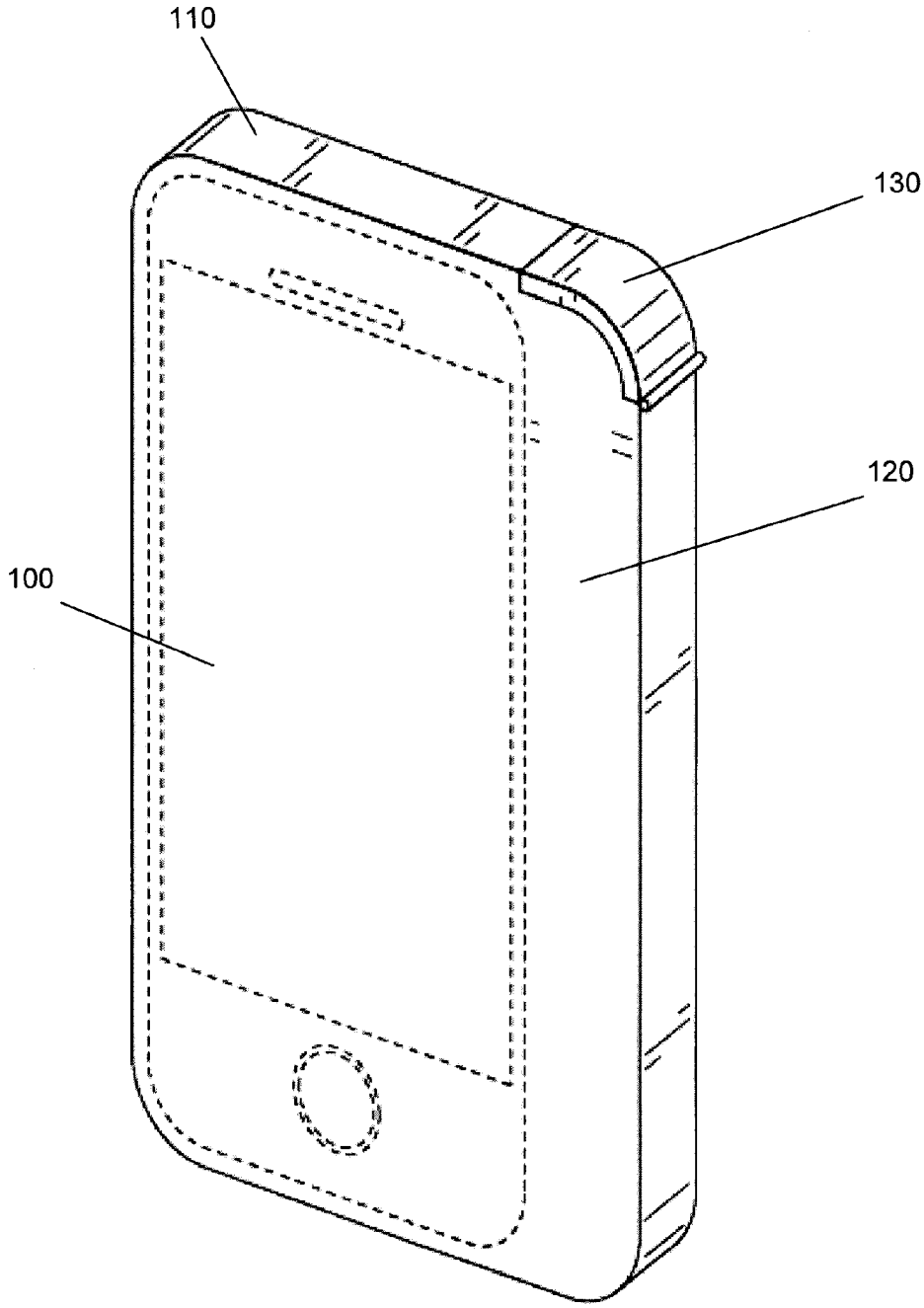
FIGS. 1A, 1B and 1C are exemplary illustrations of a mobile device case with an e-cigarette compartment, according to an embodiment of the present invention.
Figure 1B:
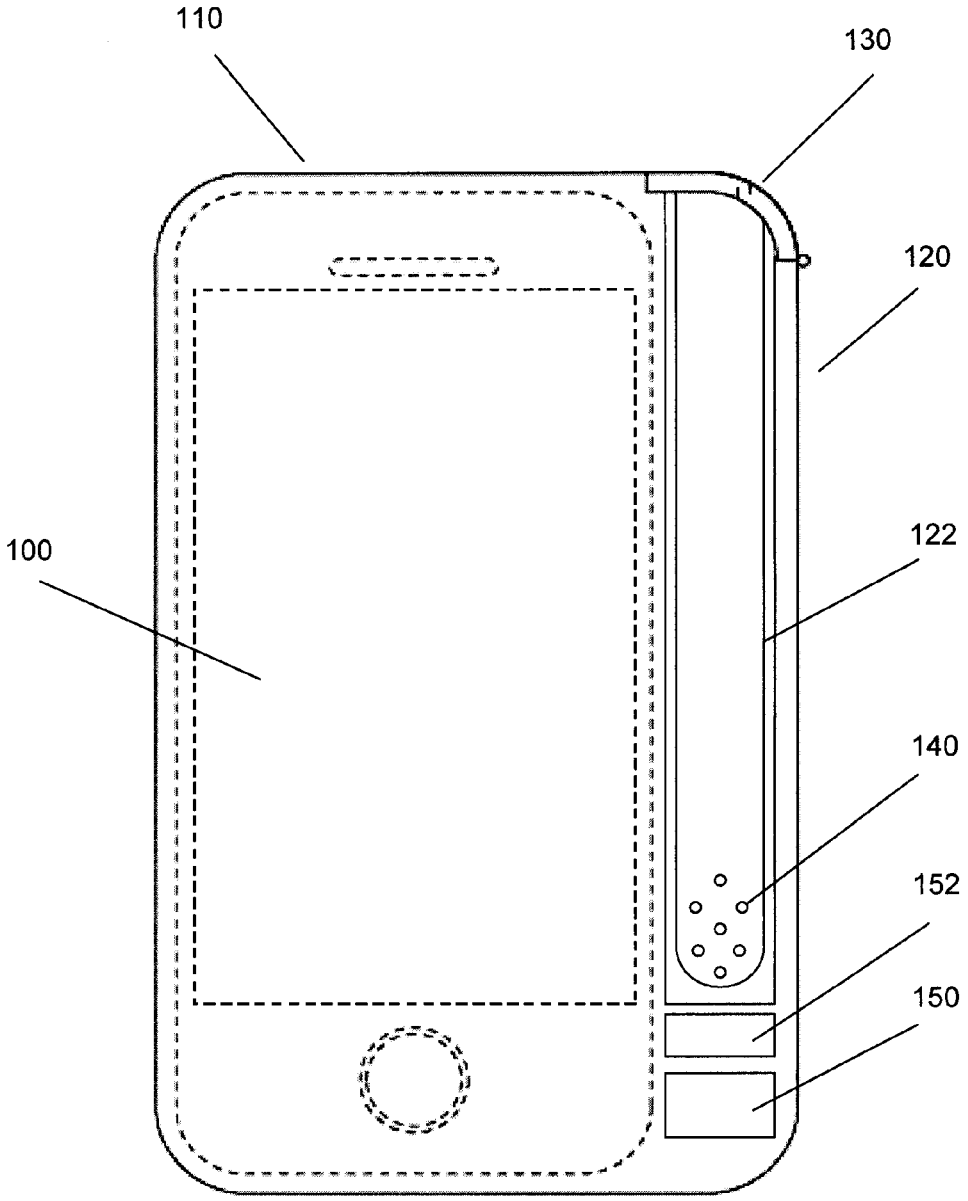
Figure 1C:
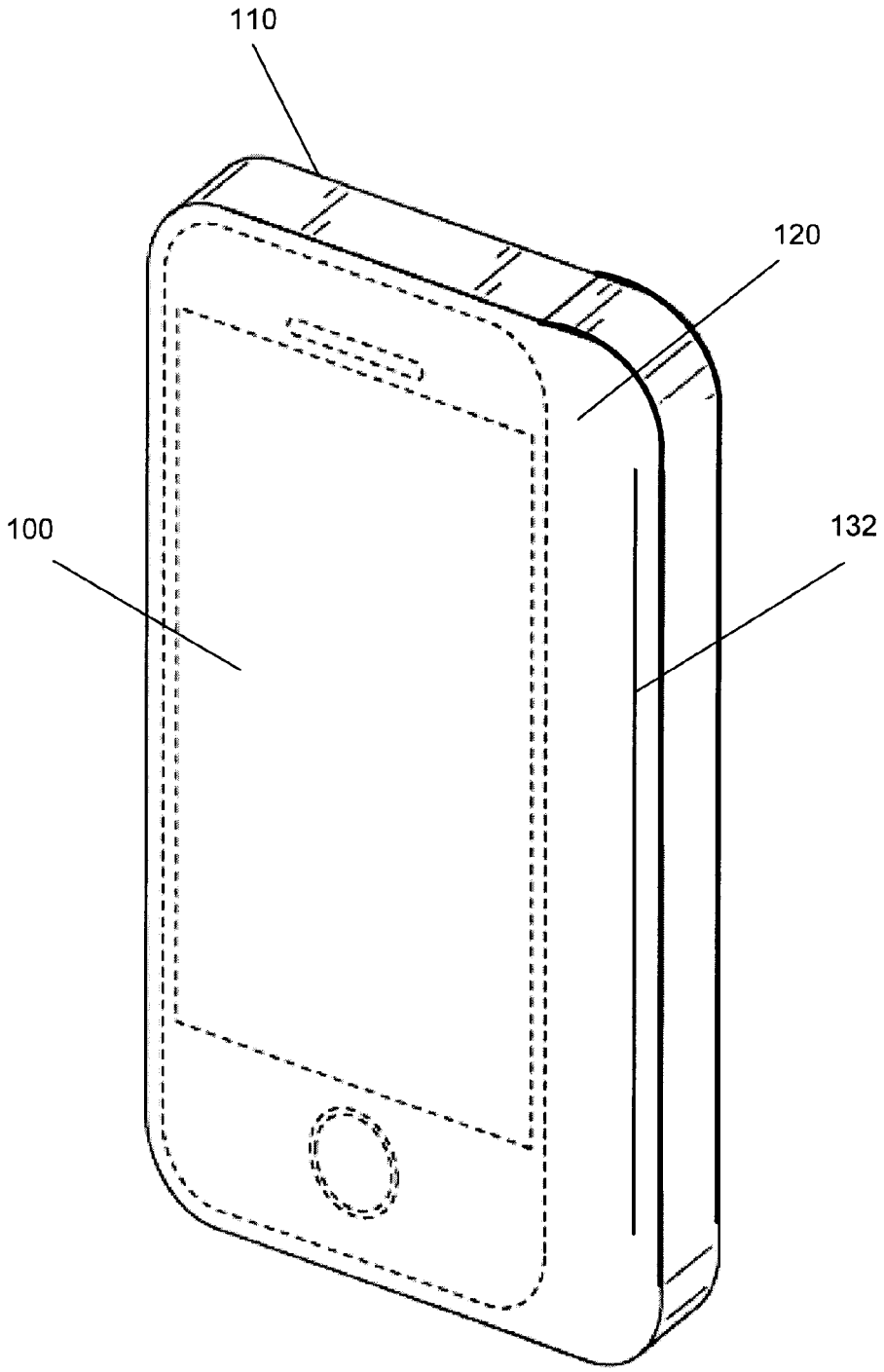

FIGS. 1A, 1B and 1C are exemplary illustrations of a mobile device case with an e-cigarette compartment, according to an embodiment of the present invention. Mobile device case 110 holds mobile device 100, which may include a mobile phone or other mobile communication/processing device. As shown in FIGS. 1A, 1B and 1C, a mobile device case 110 includes a compartment 120 configured to hold an e-cigarette along the length of the mobile device case. The mobile device case may be made primarily of various combinations of hard and soft plastic. The compartment 120 may be of varying elongated shapes, including cylindrical, rectangular, hexagonal, etc.

The compartment 120 may include a lid, such as a hinged lid 130 to securely retain the e-cigarette inside the compartment. The hinged lid 130 may be further connected to a spring mechanism so that the e-cigarette may spring out of the compartment 120 when the lid 130 is opened. According to another example, a hinged opening may be along the length or side of the compartment 120. Other types of lids and variations may be implemented. For example, a lid with a sliding movement may be implemented.

According to an exemplary illustration, the mobile device case 110 may include a silicone-based material. The compartment 120 may include a silicone-based material and further include an opening in the form of a side slit along the length or side of the compartment 120 for the e-cigarette, represented by 132, as shown in FIG. 1C. According to another example, the opening may also include a fastening mechanism or flap to securely retain the e-cigarette. Other variations may be implemented.

The compartment 120 may include a removable inner portion 122 to securely hold and cushion the e-cigarette, as shown in FIG. 1B. The inner portion protects the e-cigarette from movement and further protects the e-cigarette in the event the mobile device case 110 is dropped. The inner portion 122 may include a soft material (e.g., silicone, foam, plastic, cotton, etc.). Also, the inner portion may include cushion pads along the length of the inner portion. For example, the inner portion 122 may include a plastic or other similar material with soft cushion pads along the inside of the inner portion to securely hold an e-cigarette. The inner portion 122 may be integral with the compartment 120. In addition, the inner portion may be removable and exchangeable with other inner portions that are customized to fit different e-cigarettes of varying sizes and shapes. The inner portion also provides for easy cleaning as it may be removed for cleaning.

The mobile device case 110 may include various configurations. For example, the compartment 120 itself may be integral with the mobile device case 110 where the compartment is part of the mobile device case. According to another embodiment, the compartment 120 may be separate from the mobile device case 110. The compartment 120 may be attached to a mobile device case or mobile device itself, via an attachment mechanism, such as clip(s), strap(s), snap(s), band(s), elastic, etc. In this example, the compartment may be removable and exchangeable to accommodate different e-cigarettes of varying sizes and shapes. The compartment may also be attached to phone cases of varying sizes, shapes and brands.

The mobile device case may include various types of material and may further vary in shape and size to accommodate various mobile devices and to further accommodate different types of electronic cigarettes and vaporizers. For example, the compartment 120 configured to hold e-cigarettes may be further configured to accommodate various designs and styles. For example, the size of the electronic cigarette container may vary in diameter and/or length, and may be further adjusted so that the container securely holds each of the major brands of electronic cigarettes and even customized electronic cigarettes.

According to an embodiment of the present invention, the compartment 120 and/or inner portion 122 may further include air vents of varying configurations, sizes and shapes (e.g., circles, ovals, slits, dashes, etc.). As shown in FIG. 1B, the exemplary air vents 140 are circular in shape and may be located at one end of the compartment and/or inner portion. The air vents allow for the flow of air in and out of the compartment and/or inner portion. In addition, the air vents combat condensation and possible heat produced by the e-cigarette. According to another embodiment, the air vents may be at both ends of the compartment and/or inner portion. The air vents may also be positioned along the side of the compartment and/or inner portion. According to an embodiment of the present invention, the air vents may provide a decorative design or logo as well as a functionality purpose to release smoke, vapors and/or scent that may linger from a e-cigarette use.

According to an embodiment of the present invention, the compartment 120 may further include a charging port to recharge an e-cigarette. The charging port may include a charging interface 152 and a charger 150. The interface and charger may be separate or integrated as a single unit. For example, a charging port may enable a battery containing portion of the electronic cigarette to be attached to and/or interface, via charging interface 152, with a charger 150 of the mobile device case. For example, rechargeable e-cigarettes may be separated into two pieces, one portion containing the nicotine cartridge and atomizer, and the other portion containing the rechargeable battery and LED indicator light. In this example, the mobile device case itself may draw power from the phone, and directing the power into the e-cigarette to be charged. Other charging configurations and assemblies may be applied.

The mobile phone device 110 and compartment 120 may be made of various materials. Such materials may include a variation and/or combination of hard plastics, soft plastics, shock absorbent plastics, protective foam liners, leather, rubberized plastics, silicone, metal, leather, silicon, plastic, or other materials suitable for the construction of a mobile device case. Additionally, the mobile device case 110 may include portions made of silicone and/or foam for protective and sanitary storage. The mobile phone device 110 and compartment 120 may be made of the same or substantially same material. Also, the compartment may be made of a different material than the mobile phone case.

Figure 2A:
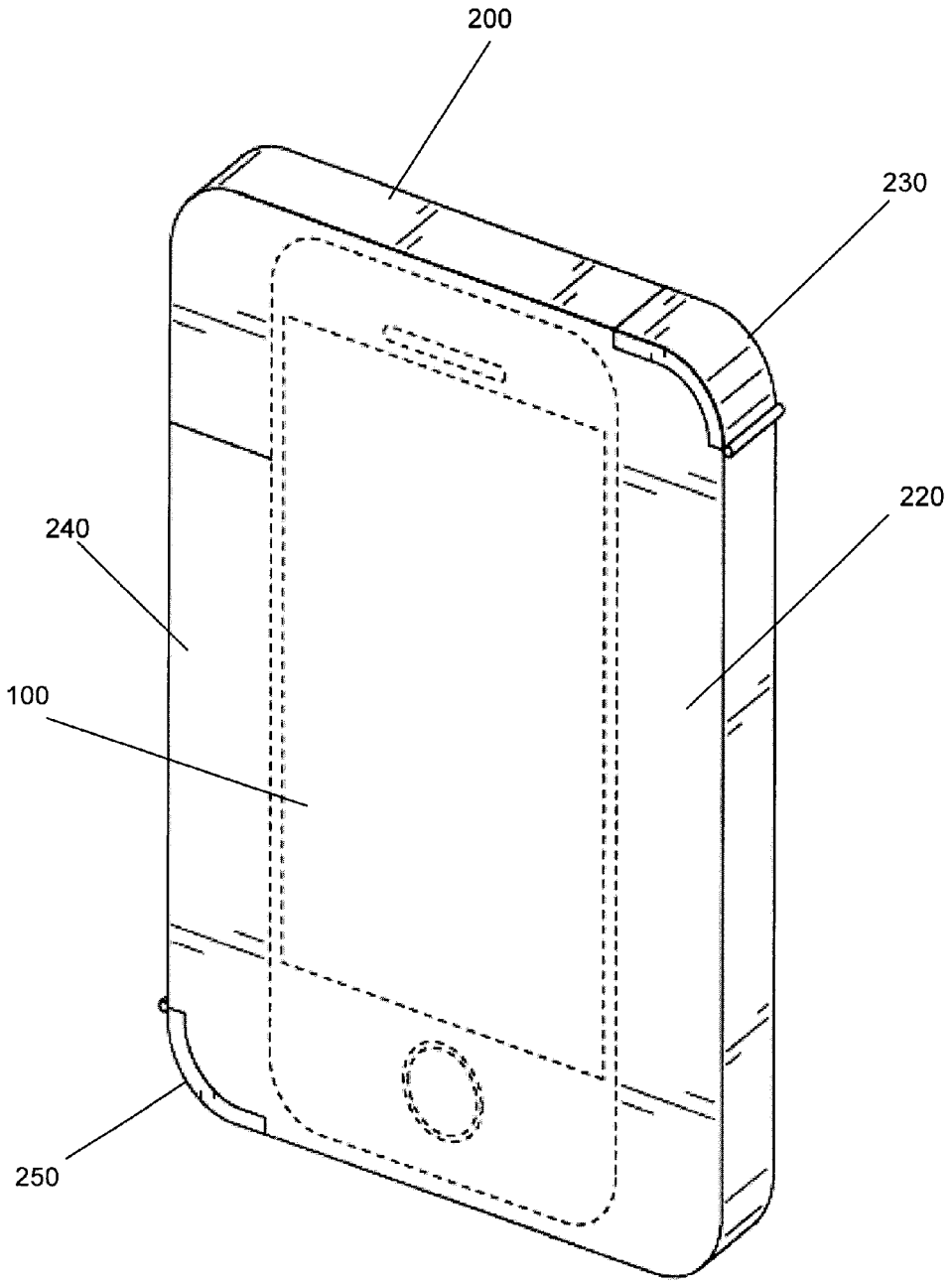
FIGS. 2A and 2B are exemplary illustrations of a mobile device case with multiple e-cigarette compartments, according to an embodiment of the present invention.
Figure 2B:
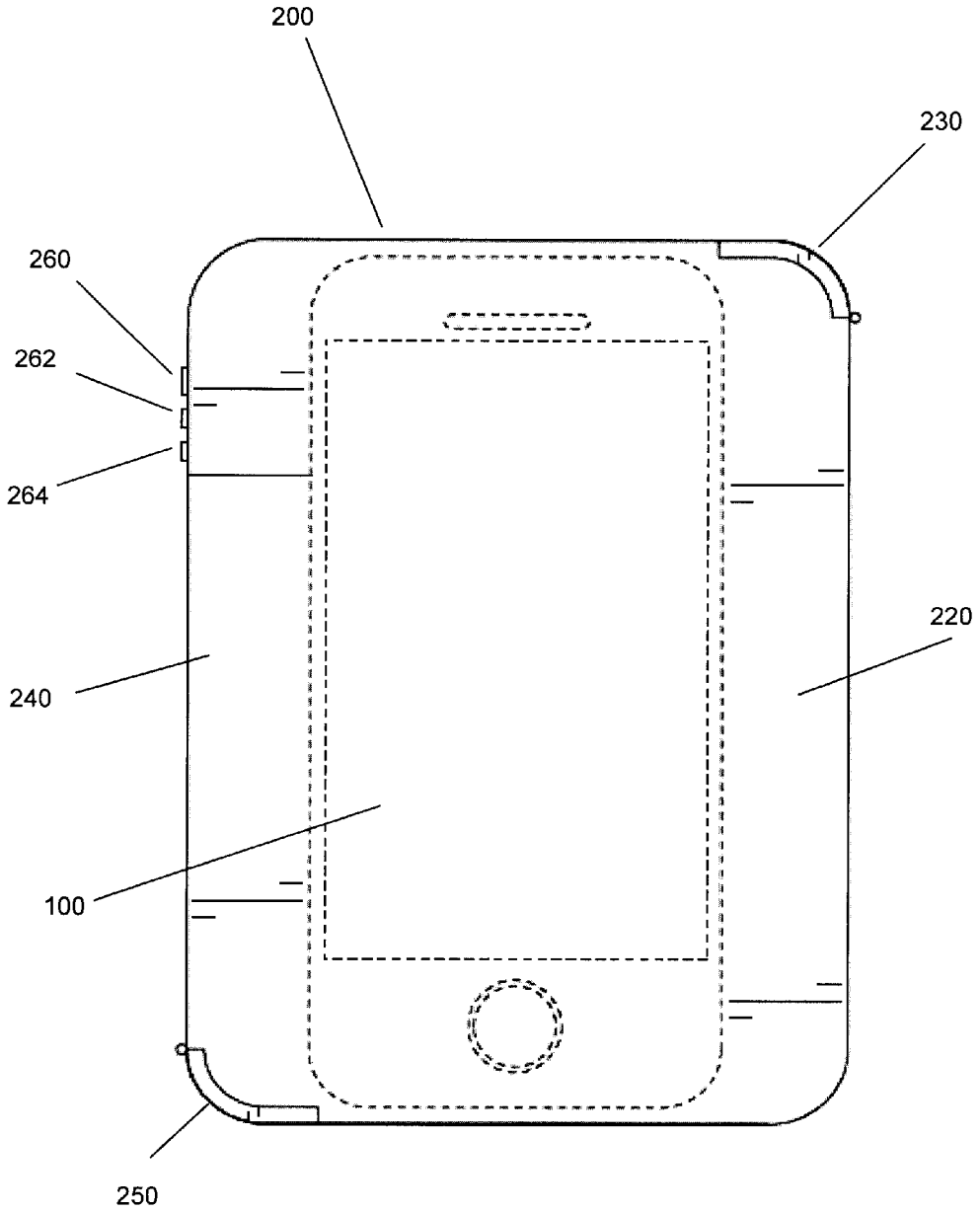

FIGS. 2A and 2B are exemplary illustrations of a mobile device case with multiple e-cigarette compartments, according to an embodiment of the present invention. The exemplary mobile device case 200 shown in FIGS. 2A and 2B includes storage for multiple e-cigarettes of varied lengths and sizes within the mobile device case. The exemplary illustration shows two hinged lids 230, 250, for each respective compartment 220, 240 for holding and protecting e-cigarettes. The compartments may include a hard and/or soft plastic case. Additionally, the mobile device case may include buttons (e.g., 260, 262, 264) or other mechanisms to toggle phone switches featured on the outside of the mobile device.

According to another example, compartment 240 may hold other items. An embodiment of the present invention may provide an additional storage space for nicotine cartridges and rechargeable e-cigarettes. For example, the mobile device case may contain a section (e.g., slot, subsection, etc.) configured to store one or more nicotine cartridges separated from a battery portion of a rechargeable e-cigarette. This exemplary configuration allows for storage of new nicotine cartridges, extending the usage of the e-cigarette being stored and protected by the mobile device case. Within this option, the mobile device case provides the ability to store additional items such as currency and/or other personal items in the additional compartment 240. Varying configurations may be implemented.

According to another example, multiple compartments may be connected side-by-side. A single elongated compartment may contain two or more e-cigarettes which may be separated by a divider. Multiple compartments in a side-by-side configuration may fold over the mobile device (not shown). Other configurations may be realized.

Figure 3A:
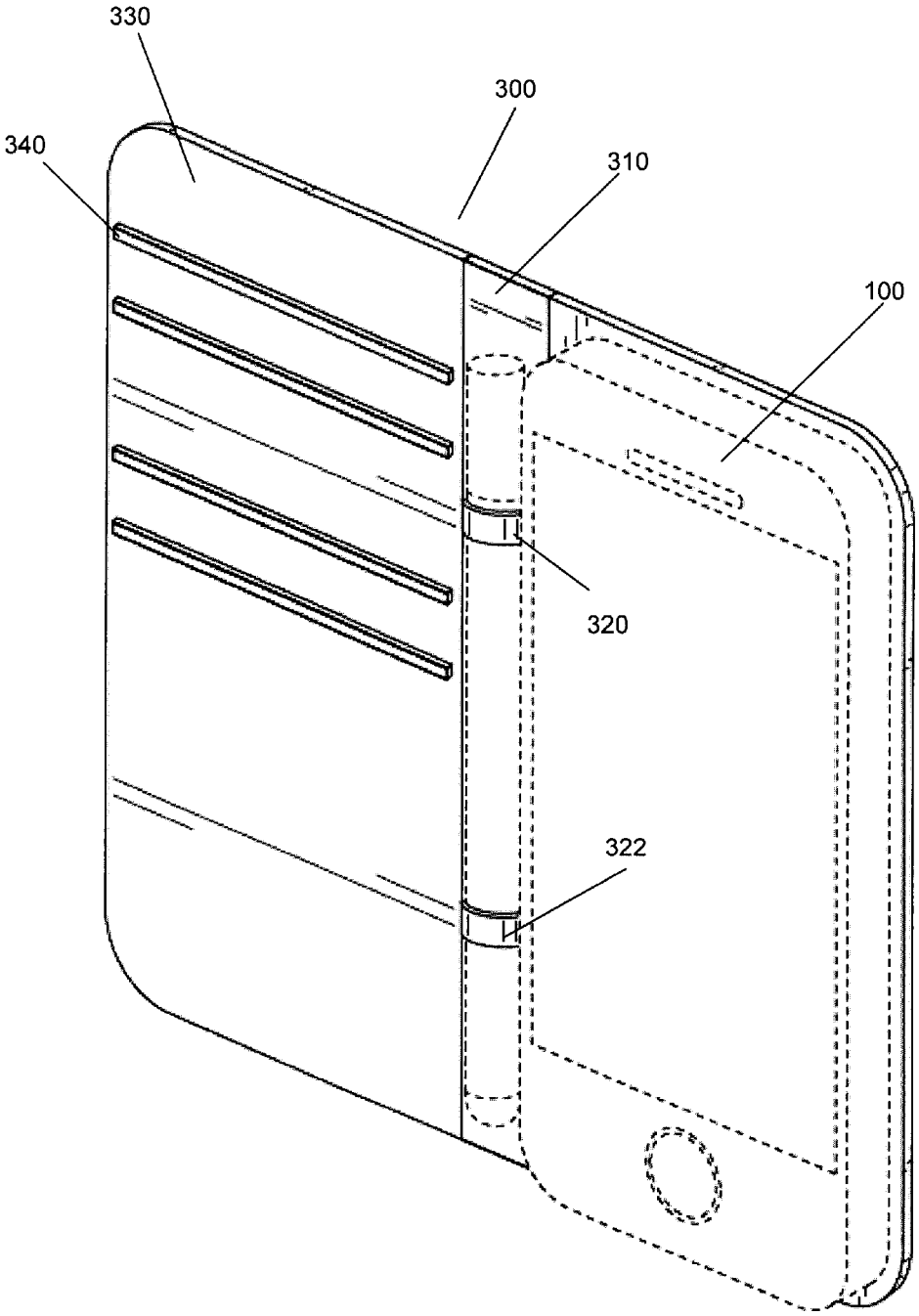
FIGS. 3A and 3B are exemplary illustrations of a mobile device case with an e-cigarette compartment and an another section for personal items, according to an embodiment of the present invention.
Figure 3B:
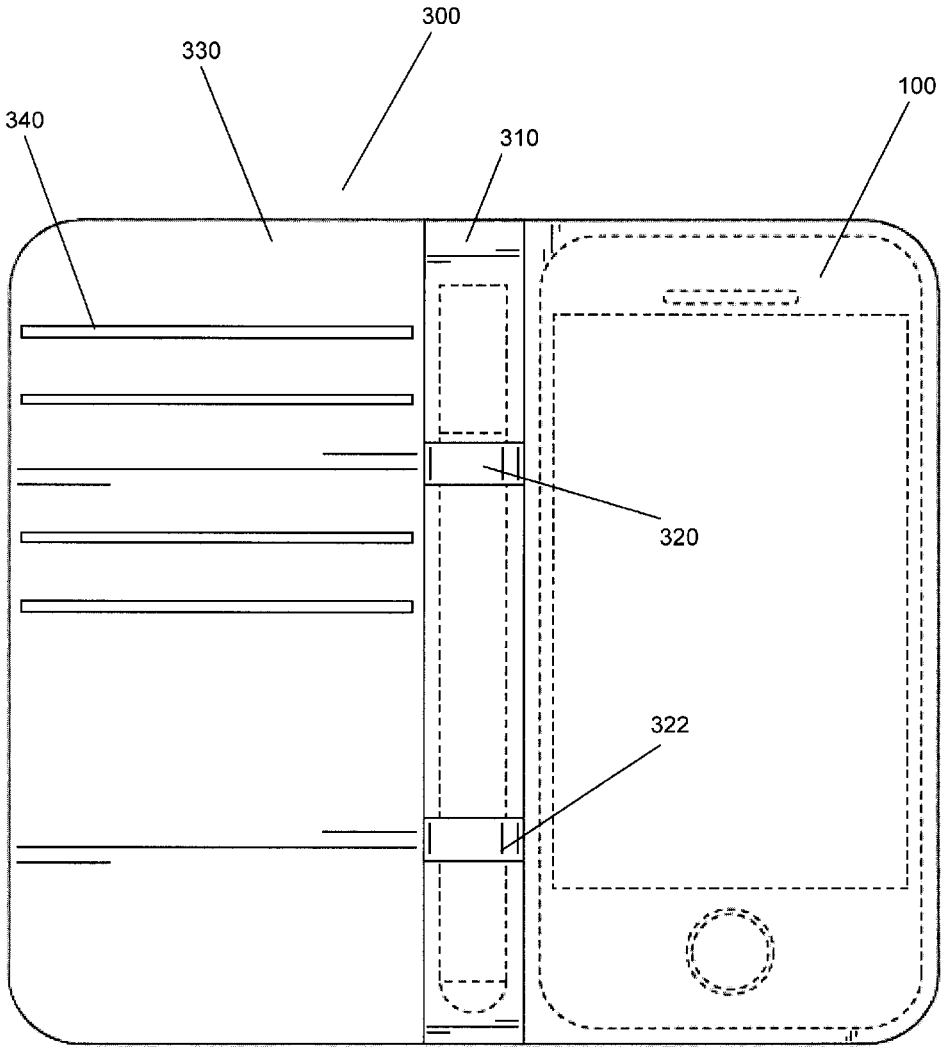

FIGS. 3A and 3B are exemplary illustrations of a mobile device case with an e-cigarette compartment and an another section for personal items, according to an embodiment of the present invention. As shown in FIG. 3, an embodiment of the present invention is directed to a mobile device case 300 with a plurality of straps 320, 322, to hold and protect an e-cigarette along an inside portion 310 of the mobile device case. The straps 320, 322 may vary in configuration (e.g., a single wide strap, multiple straps, etc.) and include a material with some elasticity. For example, the straps may include elastic, spandex, and/or plastic material bands for holding the e-cigarette inside of the case. According to another example, the straps may be made of a non-elastic material (e.g., leather, etc.) with one or more elastic subsections. Beneath the straps, the mobile device case may include a groove designed inside the case in which the e-cigarette can rest, while being supported and held by the straps 320, 322. The straps 320, 322, along with the groove imprinted into the case, provide protection and support for the e-cigarette while serving as the foundation of the mobile device case shown in FIGS. 3A and 3B.

The mobile device case, shown in FIGS. 3A and 3B, includes an additional section 330 configured to hold other items, such as currency, coins, credit/debit cards, identification cards. An embodiment of the present invention provides the ability to safely and securely transport one or more e-cigarettes in a customized highly functional mobile device case. An embodiment of the present invention fulfills a growing need for smokers of electronic cigarettes and vaporizers, also further protects and organizes everyday essentials (e.g., cell phone, currency, credit, debit and identification cards, and electronic cigarette or vaporizer, etc.) in a single device.

The connecting panels of the mobile device provide protection, storage, and an organization tool for the mobile device, e-cigarette and other personal item. The back panel of the mobile device case connects the side panels as well as the compartment for the electronic cigarette or vaporizer. The back panel further includes one or more opening for the mobile device camera and flash and/or other connecting interfaces.

The features of the mobile device case may be further configured to properly hold mobile devices of varying shapes and sizes and may further accommodate specific functionality, e.g., control buttons, power plugs, audio plugs, etc. Accordingly, the mobile device cases may be designed to accommodate mobile devices, such as phones, with various "cut-outs" that allow for access of those controls. For example, if volume controls for a phone are featured on the left side, a cut out in the case will appear on the left side, allowing for access to the controls.

The embodiments of the present inventions are not to be limited in scope by the specific embodiments described herein. For example, although many of the embodiments disclosed herein have been described with reference to a mobile device case with a compartment configured to securely retain an electronic cigarette, the principles herein are equally applicable to other types of devices and variations. Indeed, various modifications of the embodiments of the present inventions, in addition to those described herein, will be apparent to those of ordinary skill in the art from the foregoing description and accompanying drawings. Thus, such modifications are intended to fall within the scope of the following appended claims.

Further, although the embodiments of the present inventions have been described herein in the context of a particular implementation in a particular environment for a particular purpose, those of ordinary skill in the art will recognize that its usefulness is not limited thereto and that the embodiments of the present inventions can be beneficially implemented in any number of environments for any number of purposes. Accordingly, the claims set forth below should be construed in view of the full breadth and spirit of the embodiments of the present inventions as disclosed herein.

The invention claimed is:

1. A mobile device case, comprising:

a mobile device section configured to securely hold a mobile device; and a compartment attached along one side of the mobile device section, the compartment comprising:

a container configured to securely hold an e-cigarette device;

a hinged lid at one end of the container configured to close and open the container;

an inner section that fits within the container, the inner section comprising a soft material to securely hold and cushion the e-cigarette and wherein the inner section is removable from the compartment and interchangeable with one or more other inner sections of different size or shape to securely hold and cushion another e-cigarette of a different size or shape; and a plurality of air vents, each air vent having a circular shape positioned at one end of the container to release vapor from e-cigarette use.

2. The mobile device case of claim 1, wherein the mobile device comprises a second compartment configured to securely hold a second e-cigarette device.

3. The mobile device case of claim 2, wherein the second compartment is along an opposite side of the mobile device section.

4. The mobile device case of claim 2, wherein the second compartment is along a side of the compartment.

5. The mobile device case of claim 1, wherein the compartment further comprises a charging component configured to charge the e-cigarette device when contained inside the container.

6. The mobile device case of claim 1, wherein the container comprises a cylindrical or rectangular shape.

7. A mobile device case, comprising:

a mobile device section configured to securely hold a mobile device; and a compartment attached along one side of the mobile device section, the compartment comprising:

a container configured to securely hold a e-cigarette device; and an opening along the container to access the e-cigarette device; wherein the opening comprises a slit along a substantial portion of a longitudinal axis of the container to access the e-cigarette device;

wherein the compartment comprises a silicone material; and wherein the compartment comprises a plurality of air vents in the silicone material at one end of the compartment.

8. The mobile device case of claim 7, wherein the mobile device comprises a second compartment configured to securely hold a second e-cigarette device.

9. The mobile device case of claim 8, wherein the second compartment is along an opposite side of the mobile device section.

10. The mobile device case of claim 7, wherein the compartment further comprises a charging component configured to charge the e-cigarette device when contained inside the container.

11. The mobile device case of claim 7, wherein the container is removeably attachable to the mobile device section.

* * * * *